US008979516B2

(12) United States Patent
Nishide

(10) Patent No.: US 8,979,516 B2
(45) Date of Patent: Mar. 17, 2015

(54) BACK PRESSURE SPACE OF A SCROLL COMPRESSOR

(75) Inventor: Youhei Nishide, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 1029 days.

(21) Appl. No.: 13/054,029

(22) PCT Filed: Jul. 15, 2009

(86) PCT No.: PCT/JP2009/003349

§ 371 (c)(1),
(2), (4) Date: Mar. 10, 2011

(87) PCT Pub. No.: WO2010/007786

PCT Pub. Date: Jan. 21, 2010

(65) Prior Publication Data

US 2011/0158838 A1 Jun. 30, 2011

(30) Foreign Application Priority Data

Jul. 15, 2008 (JP) ..... 2008-184023

(51) Int. Cl.

*F04C 18/02* (2006.01)
*F04C 27/00* (2006.01)
*F04C 29/00* (2006.01)

(Continued)

(52) U.S. Cl.

CPC ..... *F04C 18/0215* (2013.01); *F04C 18/0261* (2013.01); *F04C 23/008* (2013.01); *F04C 27/005* (2013.01); *F04C 29/0021* (2013.01); *F04C 29/12* (2013.01)

USPC ..... 418/55.5; 418/55.1

(58) Field of Classification Search

CPC ..... F04C 18/0215; F04C 18/0261; F04C 27/005; F04C 29/0021; F04C 29/12

USPC ..... 418/55.1, 55.5

See application file for complete search history.

(56) References Cited

U.S. PATENT DOCUMENTS 5,256,044 A 10/1993 Nieter et al.
5,660,539 A 8/1997 Matsunaga et al.
6,135,738 A 10/2000 Kajiwara et al.

(Continued)

FOREIGN PATENT DOCUMENTS

CN 1512066 A 7/2004
JP 61-98987 A 5/1986

(Continued)

OTHER PUBLICATIONS

International Search Report of corresponding PCT Application No. PCT/JP2009/003349, mailed on Sep. 8, 2009.

*Primary Examiner* — Mary A Davis
(74) *Attorney, Agent, or Firm* — Global IP Counselors

(57) ABSTRACT

A scroll compressor includes a casing, a compressor mechanism, a housing, a partition member and a flow mechanism. The compressor mechanism is accommodated in the casing. The compressor mechanism includes a fixed scroll and a movable scroll arranged to form a compression chamber. The housing is disposed on a back side of the movable scroll to form a back pressure space between the housing and the movable scroll. The partition member is disposed in an interior of the casing to form an auxiliary space communicating with the back pressure space. The a flow mechanism is arranged to enable a fluid to flow between the back pressure space and the auxiliary space, and the compression chamber in a process of compression.

15 Claims, 9 Drawing Sheets

(51) Int. Cl.
*F04C 23/00* (2006.01)
*F04C 29/12* (2006.01)

(56) References Cited

U.S. PATENT DOCUMENTS

| | | | | |
|---|---|---|---|---|
| 6,514,060 | B1 | 2/2003 | Ishiguro et al. | |
| 2004/0219048 | A1* | 11/2004 | Tsuchiya et al. | 418/55.4 |
| 2006/0216182 | A1* | 9/2006 | Kohsokabe et al. | 418/55.6 |

FOREIGN PATENT DOCUMENTS

| | | | |
|---|---|---|---|
| JP | 03-111687 | A | 5/1991 |
| JP | 05-202865 | A | 8/1993 |
| JP | 08-121366 | A | 5/1996 |
| JP | 2003-42087 | A | 2/2003 |
| JP | 2006-329208 | A | 12/2006 |
| KR | 10-1999-0044128 | A | 6/1999 |
| KR | 10-2001-0093315 | A | 10/2001 |

* cited by examiner

BACK PRESSURE SPACE OF A SCROLL COMPRESSOR

CROSS-REFERENCE TO RELATED APPLICATIONS

This U.S. National stage application claims priority under 35 U.S.C. §119(a) to Japanese Patent Application No. 2008-184023, filed in Japan on Jul. 15, 2008, the entire contents of which are hereby incorporated herein by reference.

TECHNICAL FIELD

The present invention relates to scroll compressors having a fixed scroll and a movable scroll.

BACKGROUND ART

Scroll compressors configured to prevent a movable scroll from separating from a fixed scroll due to a pressure of a refrigerant gas that is generated at the time of compression of the refrigerant gas, by applying a pushing force toward the fixed scroll to the movable scroll have been known.

Japanese Patent Publication No. H08-121366 discloses an example scroll compressor of this type, in which a communication path for connecting the compression chamber and a back pressure space together is formed in the end plate of the movable scroll, to introduce a refrigerant gas in the process of being compressed into the back pressure space on the back side of the movable scroll through the communication path. This scroll compressor is configured such that the back pressure is applied to the movable scroll, thereby pushing the movable scroll to the fixed scroll.

Further, Japanese Patent Publication Nos. S61-98987 and H03-111687 disclose other example scroll compressors in which the refrigerant gas in the process of being compressed is introduced into the back pressure space of the movable scroll. These scroll compressors are configured to have, in the back side portion of the fixed scroll, a space into which the refrigerant gas in the process of being compressed is introduced, and connect the space with the back pressure space of the movable scroll, thereby applying the back pressure to the movable scroll and pushing the movable scroll to the fixed scroll.

SUMMARY

Technical Problem

However, in the scroll compressors described above in which a pushing force is applied to the movable scroll by a refrigerant gas in the process of being compressed, the back pressure applied to the movable scroll is varied due to variations in pressure during the process of compression. As a result, the pushing force of the movable scroll becomes unstable.

The present invention was made in view of the above problem, and it is an objective of the invention to stabilize the pushing force of the movable scroll.

Solution to the Problem

According to the present invention, an auxiliary space is formed in the casing; the auxiliary space is configured to communicate with a back pressure space; and variations in pressure in the back pressure space is compensated by the auxiliary space.

Specifically, the first aspect of the present invention is intended for a scroll compressor having a casing (10), and a compressor mechanism (14) which is accommodated in the casing (10) and which includes a fixed scroll (4) and a movable scroll (5), and in which a compression chamber (50) is formed between the fixed scroll (4) and the movable scroll (5). The first aspect of the present invention includes: a housing (3) provided on a back side of the movable scroll (5) and forming a back pressure space (24) between the housing (3) and the movable scroll (5); a partition member (3) provided in an interior of the casing (10) and forming an auxiliary space (16) which communicates with the back pressure space (24); and a flow mechanism (1A) which enables a fluid to flow between the back pressure space (24) and the auxiliary space (16), and the compression chamber (50) in a process of compression.

In the above structure, the back pressure space (24) provided on the back side of the movable scroll (5) communicates with the auxiliary space (16) formed in the casing (10). Thus, the pressure in the back pressure space (24) is approximately the same as the pressure in the auxiliary space (16). Here, the auxiliary space (16) is formed by the partition member (3) and the casing (10), and the capacity of the auxiliary space (16) is relatively large. Thus, even if the pressure of a fluid which is in the process of being compressed and which is introduced into the back pressure space (24) and the auxiliary space (16) from the compression chamber (50) is varied, the variation is compensated by the auxiliary space (16). As a result, variations in pressure (back pressure) in the back pressure space (24) are reduced. If the variations in back pressure in the back pressure space (24) are reduced, variations in the pushing force which pushes the movable scroll (5) to the fixed scroll (4) due to the back pressure are also reduced. As a result, the movable scroll (5) can be pushed toward the fixed scroll (4) with stability.

The second aspect of the present invention is such that in the first aspect of the present invention, the housing (3) is provided so as to partition the interior of the casing (10), and the housing (3) forms the partition member.

In the above structure, the housing (3) serves as the partition member (3), as well. That is, the housing (3), together with the casing (10), partitions the inside of the casing (10) to form the auxiliary space (16), and forms the back pressure space (24) between the housing (3) and the movable scroll (5), thereby achieving commonality of components.

The third aspect of the present invention is such that in the second aspect of the present invention, the scroll compressor includes a motor (6) connected to the compressor mechanism (14) via a drive shaft (7). Further, the housing (3) partitions the interior of the casing (10) into an accommodating space for the compressor mechanism (14) and an accommodating space for the motor (6), and the accommodating space for the compressor mechanism (14) forms the auxiliary space (16).

In the above structure, the interior of the casing (10) is partitioned into a space on the compressor mechanism (14) side in which the movable scroll (5) and the fixed scroll (4) are disposed, and a space on the motor (6) side in which the motor (6) is disposed. The space on the compressor mechanism (14) side serves as the auxiliary space (16).

The fourth aspect of the present invention is such that in the third aspect of the present invention, the flow mechanism (1A) includes a communication path (80) which extends from the fixed scroll (4) to the movable scroll (5), and which connects the compression chamber (50) and the back pressure space (24) to each other.

In the above structure, a fluid in the process of being compressed is introduced into the back pressure space (24) from the compression chamber (50) via the communication path (80) formed in the movable scroll (5).

The fifth aspect of the present invention is such that in the third aspect of the present invention, the flow mechanism (1A) includes a communication path (80) which extends from the movable scroll (5) to the fixed scroll (4), and which connects the compression chamber (50) and the auxiliary space (16) to each other.

In the above structure, a fluid in the process of being compressed is introduced into the auxiliary space (16) from the compression chamber (50) via the communication path (80) formed in the fixed scroll (4).

The sixth aspect of the present invention is such that in the third aspect of the present invention, the flow mechanism (1A) includes a communication path (80) which extends from the movable scroll (5) to the fixed scroll (4), and which connects the compression chamber (50) and the back pressure space (24) to each other.

In the above structure, a fluid in the process of being compressed is introduced into the back pressure space (24) from the compression chamber (50) via the communication path (80) formed in the movable scroll (5).

The seventh aspect of the present invention is such that in the third aspect of the present invention, the flow mechanism (1A) includes a communication path (48) which is formed in the fixed scroll (4) and which connects the compression chamber (50) and the auxiliary space (16) to each other.

In the above structure, a fluid in the process of being compressed is introduced into the auxiliary space (16) from the compression chamber (50) via the communication path (48) formed in the fixed scroll (4).

The eighth aspect of the present invention is such that in the third aspect of the present invention, the flow mechanism (1A) includes a communication path (56) which is formed in the movable scroll (5) and which connects the compression chamber (50) and the back pressure space (24) to each other.

In the above structure, a fluid in the process of being compressed is introduced into the back pressure space (24) from the compression chamber (50) via the communication path (56) formed in the movable scroll (5).

The ninth aspect of the present invention is such that in any one of the fourth to sixth aspects of the present invention, the communication path (80) communicates intermittently as the movable scroll (5) revolves.

In the above structure, effects of the variations in pressure in the compression chamber (50) are reduced, and the variations in back pressure are reduced.

The tenth aspect of the present invention is such that in the seventh or eighth aspect of the present invention, the communication path (48, 56) is provided with a check valve (49) for preventing a fluid from flowing back to the compression chamber (50).

In the above structure, the check valve (49) prevents a fluid from flowing back to the compression chamber (50) from the auxiliary space (16) or the back pressure space (24), and further can reduce the variations in back pressure.

The eleventh aspect of the present invention is such that in one of the third to tenth aspects of the present invention, a high pressure chamber (45) which is separated from the auxiliary space (16), and into which a fluid compressed in the compression chamber (50) is discharged, is provided on the back side of the fixed scroll (4). Further, flow paths (46, 39) for connecting the high pressure chamber (45) and the accommodating space for the motor (6) are formed so as to extend from the fixed scroll (4) to the housing (3), and a discharge pipe (19) which communicates with the accommodating space for the motor (6) is provided to the casing (10).

In the above structure, the fluid compressed in the compression chamber (50) flows through the high pressure chamber (45) and the first flow path (46) formed in the fixed scroll (4), and through the second flow path (39) formed in the housing (3), and flows out into the accommodating space in the casing (10) in which the motor (6) is disposed. After that, the fluid is discharged to the outside of the casing (10) via the discharge pipe (19). That is, the fluid discharged from the compression chamber (50) does not flow into the accommodating space in the casing (10) in which the fixed scroll (4) and the movable scroll (5) are disposed.

Further, the high pressure chamber (45) is positioned at a central portion of the back side of the fixed scroll (4), and therefore, the back pressure applied to the back side of the fixed scroll (4) is higher as it is closer to the central portion. On the other hand, the pressure on the compression chamber (50) side of the fixed scroll (4) is lower as it is closer to the outer peripheral side at which the compression of a fluid starts, and the pressure is higher as it is closer to the inner peripheral side at which the compression of the fluid is finished. Thus, the pressure which is applied to the back side of the fixed scroll (4), and the pressure which is applied to the compression chamber (50) side of the fixed scroll (4) can be balanced by the high pressure chamber (45) provided at the central portion of the back side of the fixed scroll (4), thereby making it possible to reduce the deformation of the fixed scroll (4).

The twelfth aspect of the present invention is such that the in any one of the third to eleventh aspects of the present invention, a space between the movable scroll (5) and the housing (3) is partitioned into a central space (23) through which the drive shaft (7) passes, and a back pressure space (24) formed on an outer side of the central space (23), and the central space (23) is in an atmosphere of a discharge pressure of the fluid.

In the above structure, the central space (23) located on the inner side, of which the pressure is a high pressure equivalent to the discharge pressure of the fluid, and the back pressure space (24) located on the outer side, of which the pressure is a pressure equivalent to a pressure of the fluid in the process of being compressed, are formed on the back side of the movable scroll (5). This means that the movable scroll (5) is pushed toward the fixed scroll (4) by the discharge pressure and the back pressure.

The thirteenth aspect of the present invention is such that in any one of the third to twelfth aspects of the present invention, the scroll compressor includes a suction pipe (18) which passes through the casing (10) and goes through the auxiliary space (16) to communicate with the compression chamber (50).

In the above structure, the suction pipe (18) passes through the casing (10) and extends to the compression chamber (50), through the auxiliary space (16), without going through the high pressure space. Thus, the fluid to be introduced into the compression chamber (50) through the suction pipe (18) can be prevented from being heated by a high pressure gas having a high temperature.

Advantages of the Invention

According to the present invention, the auxiliary space (16) partitioned by the partition member (3) and the casing (10), and the back pressure space (24) on the back side of the movable scroll (5) are connected to each other. The fluid in the process of being compressed is introduced into the auxiliary space (16) and the back pressure space (24), and therefore, even if the pressure of the fluid is varied, the variation can be compensated by the auxiliary space (16). As a result, the movable scroll (5) can be pushed toward the fixed scroll (4) with a stable pushing force.

According to the second aspect of the present invention, the housing (3) serves as the partition member (3), as well. Thus, the number of components can be reduced.

According to the fourth aspect of the present invention, the fluid in the process of being compressed can be introduced into the back pressure space (24) by simply providing the communication path (80) in the fixed scroll (4) and the movable scroll (5).

According to the fifth aspect of the present invention, the fluid in the process of being compressed can be introduced into the auxiliary space (16) by simply providing the communication path (80) in the movable scroll (5) and in the fixed scroll (4).

According to the sixth aspect of the present invention, the fluid in the process of being compressed can be introduced into the back pressure space (24) by simply providing the communication path (80) in the movable scroll (5) and the fixed scroll (4).

According to the seventh aspect of the present invention, the fluid in the process of being compressed can be introduced into the auxiliary space (16) by simply providing the communication path (48) in the fixed scroll (4).

According to the eighth aspect of the present invention, the fluid in the process of being compressed can be introduced into the back pressure space (24) by simply providing the communication path (56) in the movable scroll (5).

According to the ninth aspect of the present invention, the communication path (80) communicates intermittently as the movable scroll (5) revolves. Thus, effects of the variations in pressure in the compression chamber (50) can be reduced, and the variations in back pressure can be reduced.

According to the tenth aspect of the present invention, the check valve (49) can prevent the fluid from flowing back to the compression chamber (50) from the auxiliary space (16) or the back pressure space (24).

According to the eleventh aspect of the present invention, the fluid compressed in the compression chamber (50) is allowed to temporarily flow into the accommodating space in the casing (10) in which space the motor (6) is disposed, via the high pressure chamber (45) and the first flow path (46) formed in the fixed scroll (4), and the second flow path (39) formed in the housing (3). The fluid can be discharged from the accommodating space to the outside of the casing (10) via the discharge pipe (19). Further, the pressure which is applied to the back side of the fixed scroll (4), and the pressure which is applied to the compression chamber (50) side of the fixed scroll (4) can be balanced by the high pressure chamber (45) provided at a central portion of the back side of the fixed scroll (4), thereby making it possible to reduce the deformation of the fixed scroll (4).

According to the twelfth aspect of the present invention, the movable scroll (5) can be pushed toward the fixed scroll (4) due to high pressure and back pressure, by providing between the movable scroll (5) and the housing (3), the central space (23) having a high pressure, and the back pressure space (24) having a pressure equivalent to the pressure of the fluid in the process of being compressed. As a result, the operation region in which an appropriate pushing force can be given to the movable scroll (5) can be larger, compared to the structure in which only a high pressure is applied to the movable scroll (5) to push the movable scroll (5) toward the fixed scroll (4).

According to the thirteenth aspect of the present invention, the suction pipe (18) is configured to pass through the casing (10), go through the auxiliary space (16), and extend to the compression chamber (50), thereby making it possible to prevent the fluid flowing through the suction pipe (18) from being heated by the high pressure fluid after compression. As a result, the reduction in volume efficiency can be prevented.

BRIEF DESCRIPTION OF THE DRAWINGS

FIG. 3(*a*) is a plan view. FIG. 3(*b*) is a cross section taken along the line b-b of FIG. 3(*a*).

DESCRIPTION OF EMBODIMENTS

Embodiments of the present invention will be described in detail hereinafter, based on the drawings.

First Embodiment

Figure 1:
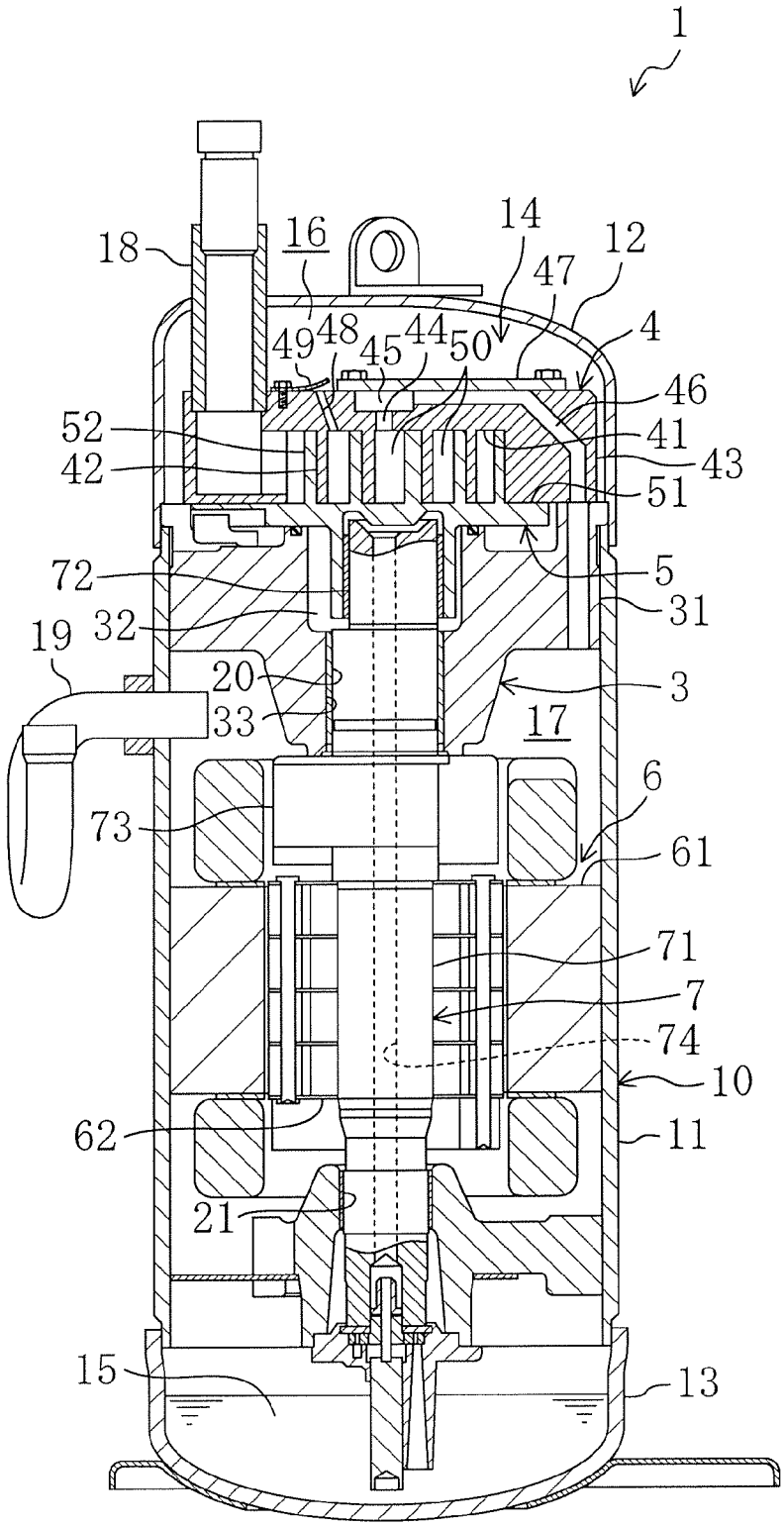
FIG. 1 is a vertical cross section of a scroll compressor according to the first embodiment of the present invention.
Figure 2:
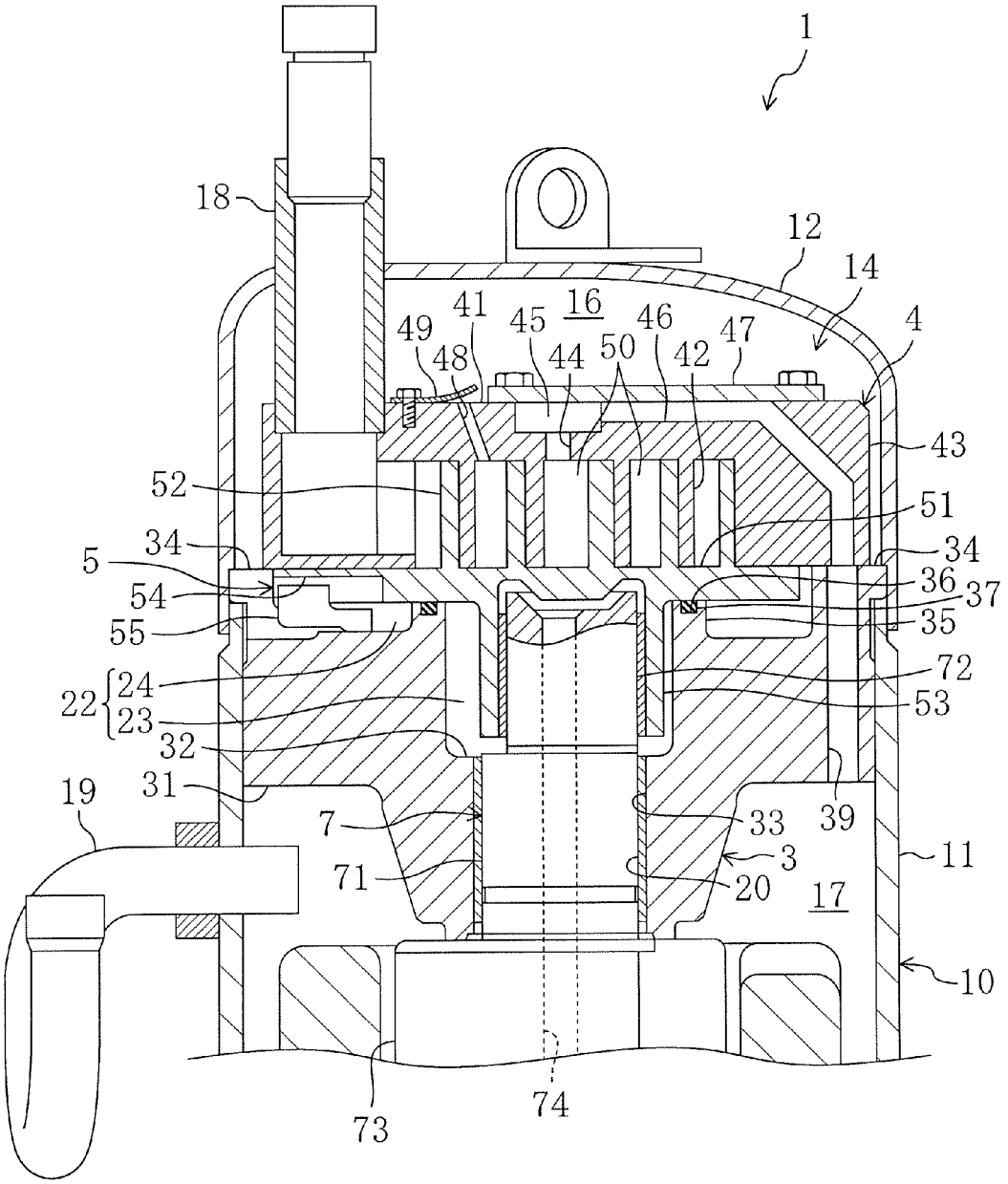
FIG. 2 is a partially enlarged view of FIG. 1.

As shown in FIG. 1 and FIG. 2, a scroll compressor (1) according to the present embodiment is connected to a refrigerant circuit (not shown) in which a refrigerant circulates to perform a refrigeration cycle, for compressing the refrigerant, i.e., a fluid.

The compressor (1) has a compressor mechanism (14) which includes a housing (3), a fixed scroll (4) and a movable scroll (5), and an enclosed-dome type, vertically-elongated cylindrical casing (10) for accommodating the compressor mechanism (14). The casing (10) includes to serve as a pressure container: a casing body (11) which is a cylindrical body having a vertically extending axis; a bowl-like upper wall portion (12) which has an upwardly protruded convex surface, and which is integrally formed with the casing body (11) by being airtightly welded with the upper end of the casing body (11); and a bowl-like bottom wall portion (13) which has an downwardly protruded convex surface, and which is integrally formed with the casing body (11) by being airtightly welded with the lower end of the casing body (11). The interior of the casing (10) is a hollow.

A compressor mechanism (14) for compressing a refrigerant, and a motor (6) located under the compressor mechanism (14) are accommodated in the interior of the casing (10). The compressor mechanism (14) and the motor (6) are connected to each other by a drive shaft (7) located so as to extend vertically in the casing (10).

An oil reservoir (15) in which lubricating oil is stored is provided at the bottom of the casing (10).

A suction pipe (18) for introducing the refrigerant in the refrigerant circuit to the compressor mechanism (14) passes through, and is airtightly fixed to, the upper wall portion (12) of the casing (10). Further, a discharge pipe (19) for discharging the refrigerant in the casing (10) out of the casing (10) passes through, and is airtightly fixed to, the casing body (11).

The drive shaft (7) includes a main shaft (71), an eccentric portion (72) which is connected to the upper end of the main shaft (71) and which is eccentric with respect to the main shaft (71), and a counter weight portion (73) provided at the main shaft (71), for achieving dynamic balance with a movable scroll (5), described later, and the eccentric portion (72), etc. A fuel path (74) extending from the upper end to the lower end of the drive shaft (7) is provided in the interior of the drive shaft (7). The lower end of the drive shaft (7) is immersed in the oil reservoir (15).

The motor (6) includes a stator (61) and a rotor (62). The stator (61) is fixed to the inside of the casing (10), specifically, to the inside of the casing body (11), by shrink-fitting etc. The rotor (62) is positioned at the inside of the stator (61) such that the rotor (62) is coaxial with the main shaft (71) of the drive shaft (7) and such that the rotor (62) cannot be rotated.

The compressor mechanism (14) includes the fixed scroll (4) which is provided at the housing (3) attached to the casing body (11) and which is located on the top surface of the housing (3), and the movable scroll (5) which is located between the fixed scroll (4) and the housing (3) and which engages with the fixed scroll (4).

Figure 3:
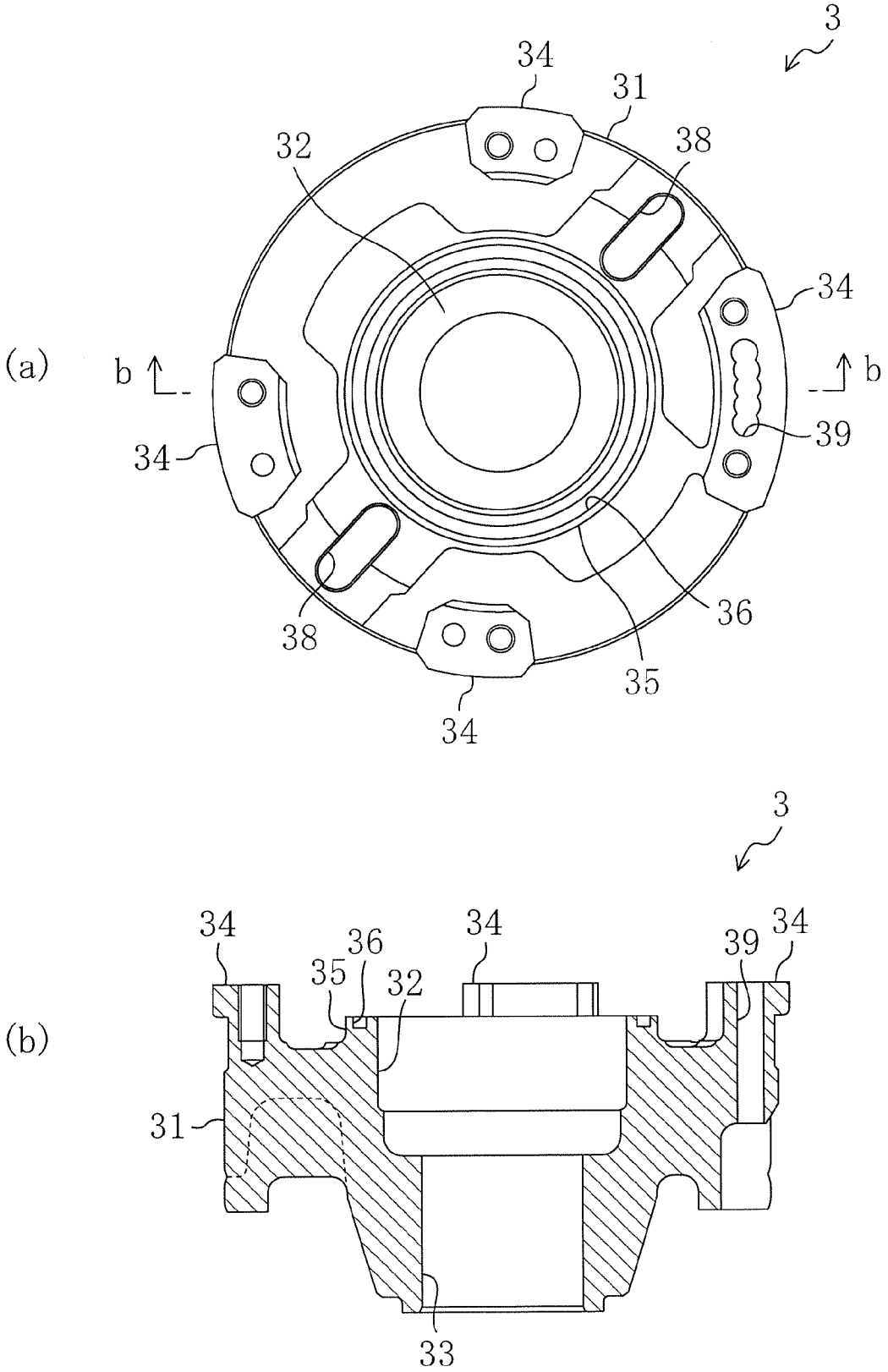
FIG. 3 shows a housing.

As shown in FIG. 3, the housing (3) includes an annular portion (31) on the outer side, and a recessed portion (32) on the inner side, and has a plate-like shape whose central portion is recessed.

As shown in FIG. 1 and FIG. 2, the housing (3) is press fitted to the upper edge of the casing body (11). Specifically, the inner peripheral surface of the casing body (11) and the outer peripheral surface of the annular portion (31) of the housing (3) are airtightly brought into contact with each other for the entire periphery. The housing (3) partitions the interior of the casing (10) into an upper space (16), i.e., an accommodating space in which the compressor mechanism (14) is accommodated, and a lower space (17), i.e., an accommodating space in which the motor (6) is accommodated.

The housing (3) has a through hole (33) which passes through the housing (3) from the bottom of the recessed portion (32) to the lower end of the housing (3). An upper bearing (20) is provided in the through hole (33). The upper end of the drive shaft (7) is rotatably supported by the upper bearing (20).

Further, a lower bearing (21) is provided in a lower portion of the casing (10). The lower end of the drive shaft (7) is rotatably supported by the lower bearing (21).

The fixed scroll (4) includes the end plate (41), a curved (involute) lap (42) formed on the front surface (the bottom surface in FIG. 1 and FIG. 2) of the end plate (41), and an outer peripheral wall (43) which is located on the outer side of the lap (42) and which is continuous with the lap (42). The end surface of the lap (42) and the end surface of the outer peripheral wall (43) are generally flush with each other. Further, the fixed scroll (4) is attached to the housing (3).

On the other hand, the movable scroll (5) includes an end plate (51), a curved (involute) lap (52) formed on the front surface (top surface in FIG. 1 and FIG. 2) of the end plate (51), and a closed-end cylindrical boss (53) formed at a central portion of the bottom surface of the end plate (51).

The movable scroll (5) is disposed such that the lap (52) is engaged with the lap (42) of the fixed scroll (4). A compression chamber (50) is formed between the contact portions between the laps (42, 52) of the fixed scroll (4) and the movable scroll (5).

A suction port (not shown) for connecting the inside and outside of the outer peripheral wall (43) is formed in the outer peripheral wall (43) of the fixed scroll (4), and the downstream end of the suction pipe (18) is connected to the suction port.

The suction pipe (18) passes through the upper wall portion (12) of the casing (10), goes through the upper space (16), and is connected to the suction port of the fixed scroll (4).

Further, a discharge opening (44) passes through a central portion of the end plate (41) of the fixed scroll (4).

A high pressure chamber (45) is provided at a central portion of the back side (the surface opposite to the surface on which the lap (42) is provided, i.e., the top surface) of the end plate (41). The discharge opening (44) is open to the high pressure chamber (45).

A first flow path (46) which communicates with the high pressure chamber (45) is formed in the fixed scroll (4). The first flow path (46) extends radially outward from the high pressure chamber (45) on the back side of the end plate (41), extends along the inner side of the outer peripheral wall (43) at the outer peripheral portion of the end plate (41), and is open at the end surface (bottom surface) of the outer peripheral wall (43). Further, a cover member (47) for closing the high pressure chamber (45) and the first flow path (46) is attached to the back side of the end plate (41). The cover member (47) allows an airtight separation between the upper space (16) of the casing (10), and the high pressure chamber (45) and the first flow path (46), thereby preventing the refrigerant gas discharged into the high pressure chamber (45) and the first flow path (46) from leaking into the upper space (16). Further, the discharged refrigerant gas flows through the first flow path (46) and through the second flow path (39), described later, of the housing (3), and flows into the lower space (17) of the casing (10).

Further, a flow mechanism (1A) for introducing the refrigerant from the compression chamber (50) to the upper space (16) of the casing (10) is provided to the end plate (41). The flow mechanism (1A) is configured to allow the refrigerant to flow in a space between the compression chamber (50) in which the refrigerant is in the process of being compressed, and the back pressure space (24) and the upper space (16). The flow mechanism (1A) has a communication path (48) for connecting the compression chamber (50) and the upper space (16) together. This means that the volume of the compression chamber (50) is gradually decreased from when the compression chamber (50) is closed, until the compression chamber (50) is open to the discharge opening (44). The end portion of the communication path (48) that is on the compression chamber (50) side is located such that the communication path (48) is open to the compression chamber (50) when the compression chamber (50) has a predetermined volume and is in a state of intermediate pressure.

Further, a reed valve (49) is provided on the back side of the end plate (41) of the fixed scroll (4), as a check valve for closing the opening of the communication path (48) that is on the upper space (16) side. This means that when the compression chamber (50) has a predetermined volume and the pressure in the compression chamber (50) is a predetermined intermediate pressure or higher pressure, the reed valve (49) is open, and the compression chamber (50) and the upper space (16) communicate with each other. Here, the intermediate pressure refers to a predetermined pressure between the pressure right after the compression chamber (50) is closed, and the pressure right before the compression chamber (50) is open to the discharge opening (44). Thus, the pressure in the upper space (16) will be an intermediate pressure due to the refrigerant gas in the process of being compressed. The upper space (16) forms the auxiliary space, i.e., a compensating space.

As shown in FIG. 3, four attachment portions (34, 34, . . . ) to which the fixed scroll (4) is attached are provided to the annular portion (31) of the housing (3). Each of these attachment portions (34, 34, . . . ) has a screw opening to fix the fixed scroll (4) by screws.

Further, the second flow path (39) is formed in one of the attachment portions (34, 34, . . . ) such that the second flow path (39) passes through the annular portion (31). The second flow path (39) is positioned at a location at which the second flow path (39) communicates with the first flow path (46) of the fixed scroll (4) when the fixed scroll (4) is attached to the housing (3). That is, the refrigerant gas discharged from the compression chamber (50) flows into the second flow path (39) through the first flow path (46), and flows out into the lower space (17) of the casing (10). The first flow path (46) and the second flow path (39) form one flow path.

Further, an inner periphery wall (35) having an annular shape is formed at the inner side of the annular portion (31) so as to surround the recessed portion (32) located in the center. The inner periphery wall (35) is lower in height than the attachment portions (34, 34, . . . ), and higher than the other portion of the annular portion (31).

Further, a seal groove (36) having an annular shape along the inner periphery wall (35) is formed in the end surface of the inner periphery wall (35). As shown in FIG. 2, an annular seal ring (37) is fitted to the seal groove (36). The seal ring (37) is in contact with the back side of the end plate (51) of the movable scroll (5) (the surface opposite to the surface on which the lap (52) is provided, i.e., the bottom surface), with the fixed scroll (4) and the movable scroll (5) engaging with each other, and the fixed scroll (4) being attached to the housing (3).

That is, the seal ring (37) partitions the space (22) on the back side of the movable scroll (5), the space (22) being partitioned by the housing (3) and the movable scroll (5), into a central space (23) on the inner side of the seal ring (37), and a back pressure space (24) on the outer side of the seal ring (37).

The central space (23) forms a central space, in which the eccentric portion (72) of the drive shaft (7) and the boss (53) of the movable scroll (5) are located. The eccentric portion (72) is rotatably inserted into the boss (53) of the movable scroll (5). The fuel path (74) is open at the upper end of the eccentric portion (72). That is, a high pressure oil is supplied into the boss (53) through the fuel path (74), and the sliding surface between the boss (53) and the eccentric portion (72) is lubricated by the oil.

Further, the central space (23) communicates with the lower space (17) of the casing (10) via a space between the upper bearing (20) and the drive shaft (7).

The back pressure space (24) communicates with the upper space (16) of the casing (10) via a space between the housing (3) and the fixed scroll (4). Specifically, the attachment portions (34, 34, . . . ) of the housing (3) to which the fixed scroll (4) is attached protrude upward at the annular portion (31) as shown in FIG. 3. Thus, a space is created between the fixed scroll (4) and the annular portion (31) of the housing (3) in the area other than the attachment portions (34, 34, . . . ). The back pressure space (24) and the upper space (16) of the casing (10) communicate with each other via this space.

Further, an Oldham coupling (55) for preventing the rotation of the movable scroll (5) on its axis is provided in the back pressure space (24), the Oldham coupling (55) being engaged with a key way (54) formed in the back side of the end plate (51) of the movable scroll (5), and key ways (38, 38) formed in the annular portion (31) of the housing (3).

—Operational Behavior of Scroll Compressor (1)—

When the motor (6) is activated, the movable scroll (5) of the compressor mechanism (14) is rotated. The rotation of the movable scroll (5) on its axis is prevented by the Oldham coupling (55), and the movable scroll (5) revolves about an axis of the drive shaft (7). As the movable scroll (5) revolves, the volume of the compression chamber (50) is decreased toward the center, and the compression chamber (50) compresses the refrigerant gas suctioned by the suction pipe (18). The refrigerant gas after compression is discharged into the high pressure chamber (45) via the discharge opening (44) of the fixed scroll (4). The high pressure refrigerant gas discharged into the high pressure chamber (45) flows through the first flow path (46) of the fixed scroll (4), and then flows into the second flow path (39) of the housing (3) to flow out into the lower space (17) of the casing (10). The refrigerant gas having flowed out into the lower space (17) is discharged to the outside of the casing (10) via the discharge pipe (19).

The pressure in the lower space (17) of the casing (10) is a pressure equivalent to the high pressure refrigerant gas to be discharged, that is, a discharge pressure. The discharge pressure is applied to the oil stored in the oil reservoir (15) located under the lower space (17), as well. As a result, a high pressure oil flows from the downstream end toward the upstream end of the fuel path (74) of the drive shaft (7), and flows into the boss (53) of the movable scroll (5) through the upper end opening of the eccentric portion (72) of the drive shaft (7). The oil supplied to the boss (53) lubricates the sliding surface between the boss (53) and the eccentric portion (72) of the drive shaft (7), and flows out into the central space (23). The central space (23) is filled with the high pressure oil in this way. Thus, the pressure in the central space (23) is a pressure equivalent to the discharge pressure.

On the other hand, since the communication path (48) is formed in the end plate (41) of the fixed scroll (4), the refrigerant gas in the process of being compressed in the compressor mechanism (14) flows out into the upper space (16) of the casing (10) via the communication path (48). The upper space (16) communicates with the back pressure space (24) on the back side of the movable scroll (5), and therefore, the pressure in the back pressure space (24) as well is a pressure equivalent to the pressure of the refrigerant gas in the process of being compressed (intermediate pressure).

This means that the high pressure in the central space (23) and the intermediate pressure in the back pressure space (24) are applied to the back side of the end plate (51) of the movable scroll (5). These back pressures give a pushing force in an axial direction that pushes the movable scroll (5) toward the fixed scroll (4). The pushing force pushes the movable scroll (5) toward the fixed scroll (4) against a separating force which is applied to the movable scroll (5) during the compression of the refrigerant gas, that is, against the force which separates the movable scroll (5) from the fixed scroll (4). As a result, the movable scroll (5) is prevented from being tilted (overturned) due to the separating force.

If the pushing force is too high with respect to the separating force, a thrust loss increases, resulting in a decrease in reliability of the scroll compressor (1). On the contrary, if the pushing force is too low with respect to the separating force, the movable scroll (5) tends to be tilted easily, resulting in a decrease in performance and reliability of the scroll compressor (1).

In the present embodiment, an appropriate pushing force is given to the movable scroll (5) by appropriately adjusting: the ratio between an area of the back side of the movable scroll (5) to which the high pressure is applied, and an area of the back side of the movable scroll (5) to which the intermediate pressure is applied; the location of the opening of the communication path (48) formed in the fixed scroll (4) that is on the compression chamber (50) side; and an opening pressure of the reed valve (49) provided to the fixed scroll (4).

In particular, according to the present embodiment, the pushing force given to the movable scroll (5) can be stabilized in the structure in which the intermediate pressure is applied to the back side of the movable scroll (5), by allowing the large capacity upper space (16) partitioned by the casing (10) to communicate with the back pressure space (24), and allowing the refrigerant gas in the process of being compressed to temporarily flow into the upper space (16) and thereafter allowing the refrigerant gas to be introduced into the back pressure space (24) via the upper space (16).

Specifically, the refrigerant gas in the process of being compressed is introduced into the upper space (16) from the compression chamber (50) via the communication path (48). The communication path (48) is open to the compression chamber (50) in the course of compression of the refrigerant gas as the compression chamber (50) moves toward the center. This means that the refrigerant gas is being compressed also during a period after the communication path (48) is open to the compression chamber (50) until the communication path (48) is closed to the compression chamber (50). Thus, the pressure of the refrigerant gas in the process of being compressed and introduced into the upper space (16) (i.e., an intermediate pressure) is varied. If a communication path is formed in the end plate (51) of the movable scroll (5) to achieve direct communication between the compression chamber (50) having the intermediate pressure and the back pressure space (24), the variations in the intermediate pressure of the compression chamber (50) are applied to the back side of the movable scroll (5). As a result, the pushing force given to the movable scroll (5) due to the back pressure is also varied according to the variations in the intermediate pressure.

In contrast, according to the present embodiment, variations in the intermediate pressure of the compression chamber (50) are compensated by the large capacity upper space (16) of which at least part is partitioned by the casing (10). The variations are then transmitted to the back pressure space (24). Thus, the intermediate pressure after variations is applied to the back side of the movable scroll (5). As a result, it is possible to stabilize the pushing force given to the movable scroll (5) due to the back pressure. In other words, the upper space (16) serves as an auxiliary space which compensates the variations in pressure of the refrigerant gas in the process of being compressed.

Further, according to the present embodiment, the high pressure and the intermediate pressure are applied to the back side of the movable scroll (5), thereby making it possible to give an appropriate pushing force to the movable scroll (5), and possible to increase an operation region in which the scroll compressor (1) can be smoothly operated.

Figure 4:
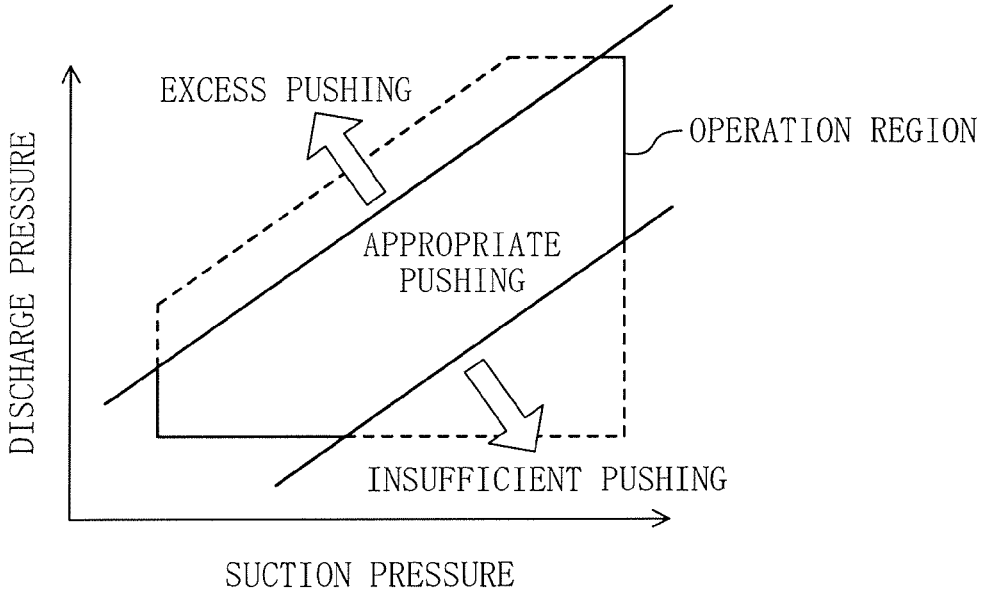
FIG. 4 is a conceptual drawing as a comparative example, for illustrating an operation region of a scroll compressor in which only a high pressure is used to give a pushing force to a movable scroll.

Specifically, if the structure is such that the pushing force is given to the back side of the movable scroll (5) only by the discharge pressure, the pushing force tends to be too strong in a region where the discharge pressure is high and the suction pressure is low, and the pushing force tends to be insufficient in a region where the discharge pressure is low and the suction pressure is high, because the back pressure which is applied to the movable scroll (5) is increased or decreased like the discharge pressure. As a result, the operation region in which the scroll compressor (1) can be smoothly operated is reduced as shown in FIG. 4.

Figure 5:
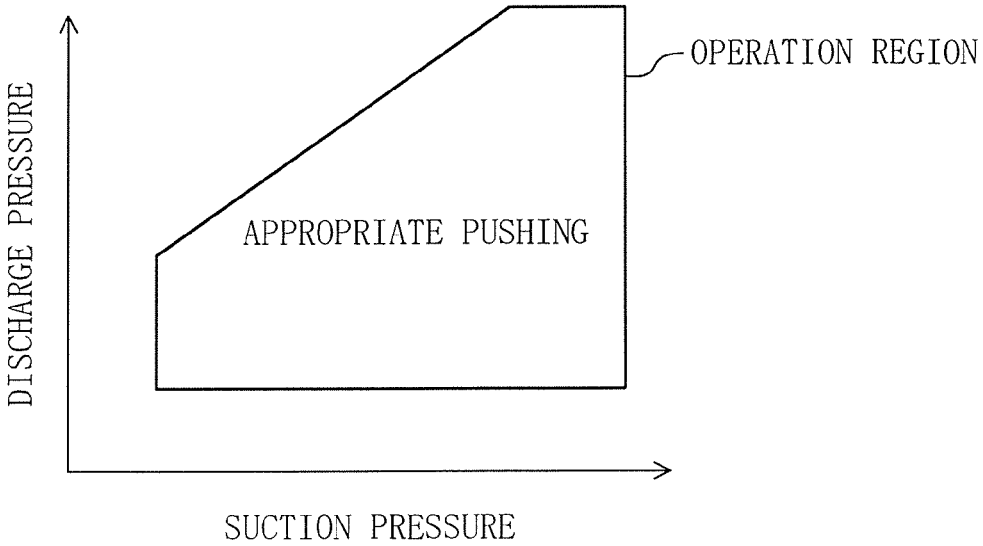
FIG. 5 is a conceptual drawing for illustrating an operation region of a scroll compressor in which a high pressure and an intermediate pressure are used to give a pushing force to a movable scroll.

In contrast, in the case where the discharge pressure and the intermediate pressure are applied to the back side of the movable scroll (5), the pushing force does not tend to be too strong even in the region where the discharge pressure is high and the suction pressure is low, because part of the pushing force is the intermediate pressure whose pressure is not as high as the discharge pressure. Also, in the region where the discharge pressure is low and the suction pressure is high, the intermediate pressure becomes higher than the discharge pressure (i.e., the high pressure of the refrigeration cycle) particularly in a so-called excessive compression state, and a sufficient pushing force can be given by applying this intermediate pressure to the movable scroll (5). Thus, the pushing force does not tend to be insufficient. As a result, the operation region in which the scroll compressor (1) can be smoothly operated can be increased, as shown in FIG. 5, by applying the high pressure and the intermediate pressure to the back side of the movable scroll (5).

Further, according to the present embodiment, the inside of the casing (10) is partitioned into the upper space (16) and the lower space (17) by the housing (3) which forms the space (22) on the back side of the movable scroll (5). Thus, it is not necessary to provide another member to partition the inside of the casing (10). Thus, the number of components can be reduced.

Further, according to the present embodiment, the upper space (16) in which the compressor mechanism (14) is located is used as an auxiliary space. Thus, the intermediate pressure can be introduced into the upper space (16) by connecting the compression chamber (50) and the upper space (16) together by simply forming the communication path (48) in the end plate (41) of the fixed scroll (4).

Further, the reed valve (49) provided at the end plate (41) of the fixed scroll (4), for opening and closing the communication path (48), prevents the refrigerant gas from flowing back to the compression chamber (50) from the upper space (16) if the pressure in the compression chamber (50) is lower than the pressure in the upper space (16). Therefore, variations in intermediate pressure can be prevented even in such a case.

Further, no sealing structure between the fixed scroll (4) and the housing (3) is necessary in the structure in which the upper space (16) serves as an auxiliary space and in which the upper space (16) and the back pressure space (24) are connected to each other to make the back pressure space (24) also have an intermediate pressure. Thus, the diameter of the fixed scroll (4) can be reduced, which leads to a reduction in size of the compressor mechanism (14).

In the case where the upper space (16) serves as a high pressure space, and the back pressure space (24) serves as an intermediate pressure space, a sealing structure needs to be provided between the fixed scroll (4) and the housing (3) to maintain an airtight seal between the upper space (16) and the back pressure space (24). In this case, the attachment surface of the fixed scroll (4) needs to have a space for the location of a seal ring etc. This increases the size of the fixed scroll (4) especially in a radial direction.

In contrast, according to the present embodiment, it is not necessary to maintain an airtight seal between the upper space (16) and the back pressure space (24). On the contrary, the upper space (16) and the back pressure space (24) are connected to each other. Thus, it is not necessary to provide a sealing structure between the fixed scroll (4) and the housing (3), and as a result, an increase in size of the fixed scroll (4) in the radial direction can be prevented.

Further, the upper space (16) serves as an auxiliary space. Therefore, the pressure in the upper space (16) is basically lower, compared to the case where the upper space (16) is used as a high pressure space. Thus, it is possible to reduce the thickness of the upper wall portion (12).

Further, the first flow path (46) is provided in the fixed scroll (4), and the second flow path (39) which communicates with the first flow path (46) is formed in the housing (3). Thus, the high pressure refrigerant gas can be introduced into the lower space (17) without flowing out into the upper space (16) located on the back side of the fixed scroll (4).

Here, the high pressure chamber (45) is provided at a central portion of the back side of the end plate (41) of the fixed scroll (4). Thus, the pressure which is applied to the central portion of the back side of the end plate (41) is higher than the pressure which is applied to the other portion (the portion to which the intermediate pressure is applied). On the other hand, the pressure in the compression chamber (50) is lower as it is closer to the outer side at which an intake port is provided, and higher as it is closer to the center at which the discharge opening (44) is provided. Therefore, the end plate (41) can withstand the high pressure applied by the refrigerant gas in the compression chamber (50), because the high pressure chamber (45) is provided on the central portion of the back side of the end plate (41), and a high back pressure is applied to that central portion, to which a high pressure is applied by the refrigerant gas when the refrigerant gas is compressed. Although only the intermediate pressure is applied to the outer side of the end plate (41), the outer side of the end plate (41) can also withstand the pressure applied by the refrigerant gas in the compression chamber (50) because the pressure of the refrigerant gas at the time of compression is not high on the outer side. That is, the pressure applied to the back side of the fixed scroll (4) and the pressure applied to the compression chamber (50) side of the fixed scroll (4) are balanced, thereby making it possible to prevent deformation of the fixed scroll (4).

Further, according to the present embodiment, the suction pipe (18) which passes through the casing (10) and communicates with the compressor mechanism (14) is disposed so as to go through the upper space (16) which serves as an intermediate pressure space. Thus, the refrigerant gas which flows through the suction pipe (18) and is drawn into the compression chamber (50) can be prevented from being heated, and as a result, it is possible to prevent a reduction in volume efficiency.

Further, the compressors shown in Patent Documents 2 and 3 are configured such that an upper space of the casing serves as a high pressure space, and such that a space into which a refrigerant gas in the process of being compressed is introduced is provided on the back side of a fixed scroll, and this space communicates with the back pressure space of a movable scroll. In such a structure, a cover for separating the space from the upper space needs to be configured movable so that the high pressure in the upper space can be compensated by the space, while providing airtight seal between the space and the upper space. Such a structure is not necessary in the present embodiment, and the sealing between the upper space (16) having an intermediate pressure and a high pressure space, such as the high pressure chamber (45) and the first flow path (46), can be fixed. Thus, it is possible to increase reliability and reduce costs.

Second Embodiment

Now, the second embodiment of the present invention will be described in detail based on the drawings.

Figure 6:
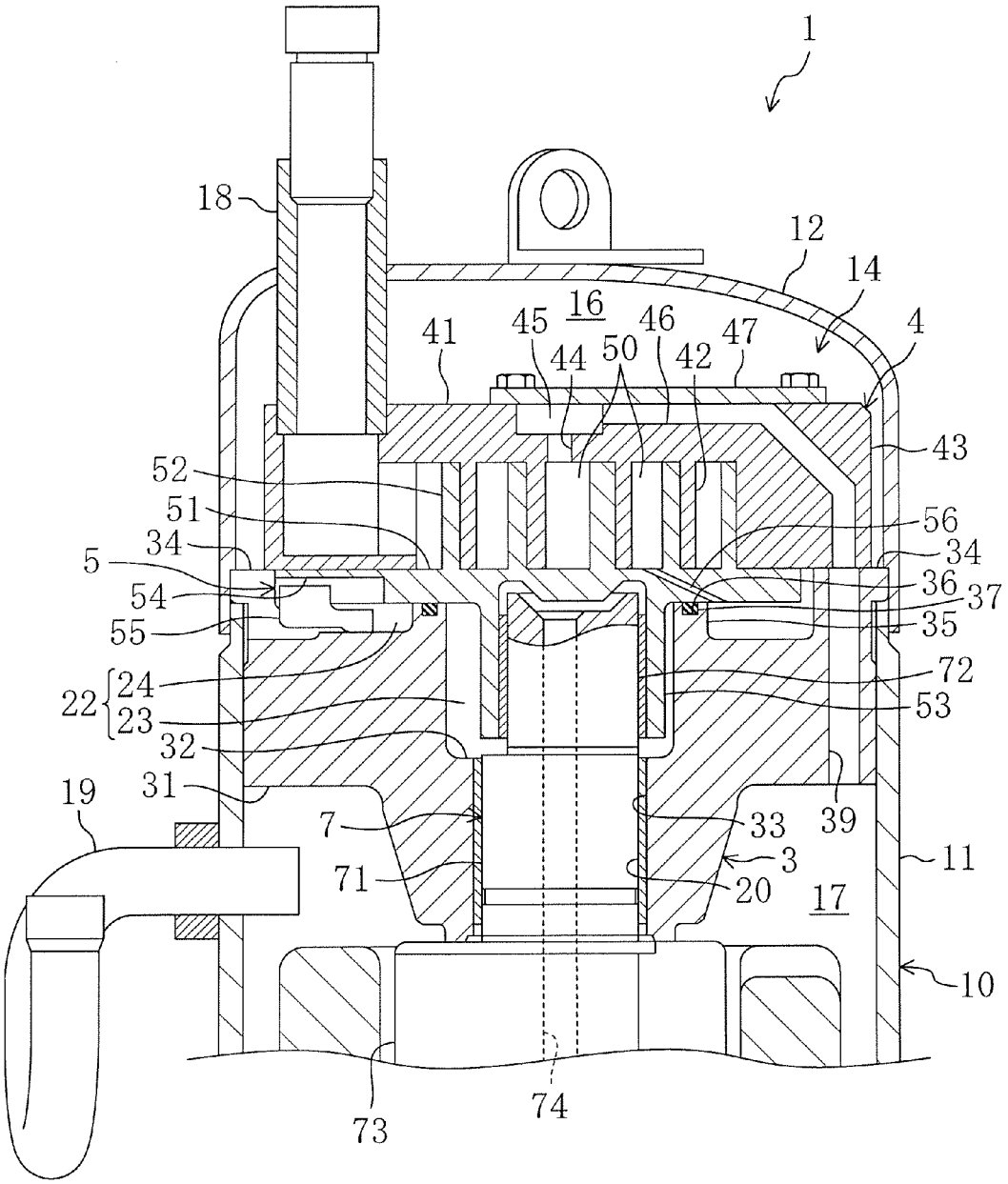
FIG. 6 is a vertical cross section for showing part of a scroll compressor according to the second embodiment of the present invention.

The flow mechanism (1A) of the first embodiment is configured to introduce the refrigerant gas in the process of being compressed from the compression chamber (50) to the upper space (16) by using the communication path (48) formed in the end plate (41) of the fixed scroll (4). In place of this structure of the first embodiment, the flow mechanism (1A) of the present embodiment is configured to introduce the refrigerant gas in the process of being compressed from the compression chamber (50) to the back pressure space (24) through a communication path (56) formed in the end plate (51) of the movable scroll (5), for connecting between the compression chamber (50) and the back pressure space (24), as shown in FIG. 6.

In the present embodiment as well, the back pressure space (24) and the upper space (16) are connected to each other through the space between the housing (3) and the fixed scroll (4). Thus, variations in pressure of the refrigerant gas in the process of being compressed are compensated by the large capacity space including the back pressure space (24) and the upper space (16). As a result, variations in back pressure which is applied to the movable scroll (5) can be reduced, thereby making it possible to stabilize the pushing force given to the movable scroll (5). In this case, too, the upper space (16) serves as an auxiliary space which compensates variations in pressure of the refrigerant gas in the process of being compressed. The other structures and effects are the same as those in the first embodiment.

Third Embodiment

Now, the third embodiment of the present invention will be described in detail based on the drawings.

Figure 7:
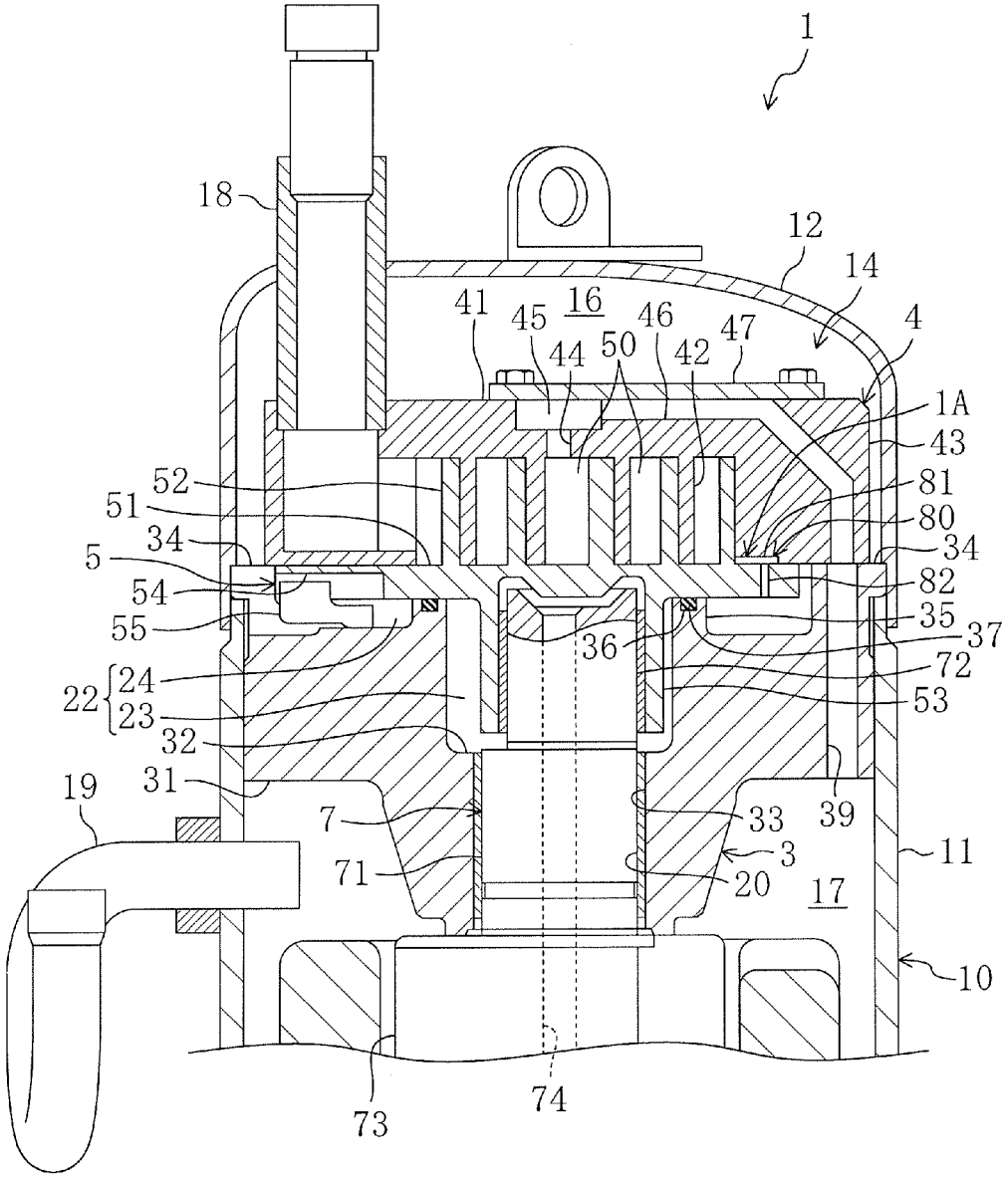
FIG. 7 is a vertical cross section for showing part of a scroll compressor according to the third embodiment of the present invention.
Figure 8:
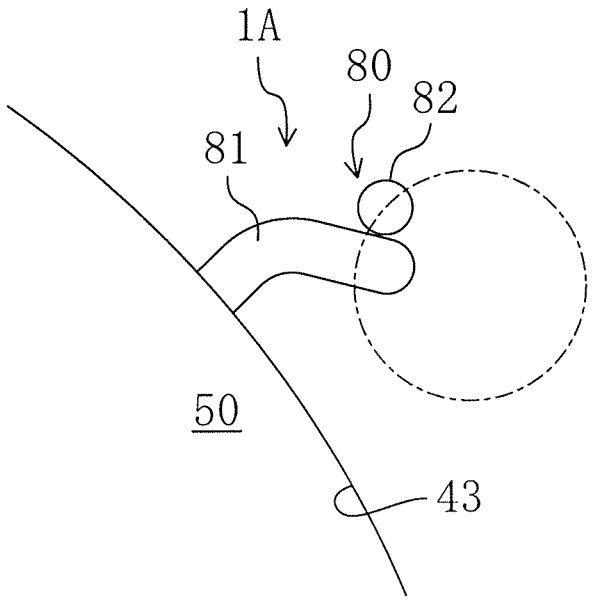
FIG. 8 is a schematic plan view of a flow mechanism according to the third embodiment of the present invention.

As shown in FIG. 7 and FIG. 8, the structure of the flow mechanism (1A) of the present embodiment is such that a communication path (80) extends from the fixed scroll (4) to the movable scroll (5), different from the structure in the first embodiment in which the communication path (48) is formed in the fixed scroll (4).

Specifically, the communication path (80) includes a primary path (81) formed in the fixed scroll (4), and a secondary path (82) formed in the movable scroll (5). The primary path (81) is a recessed portion formed in the bottom surface of the outer peripheral wall (43) of the fixed scroll (4), and the bottom surface of the primary path (81) is closed by the top surface of an outer peripheral portion of the end plate (51) of the movable scroll (5). The primary path (81) extends from the inner peripheral edge to the outer peripheral edge of the outer peripheral wall (43). One end of the primary path (81) is open at the inner peripheral surface of the outer peripheral wall (43), and communicates with the compression chamber (50) in a state of intermediate pressure that is formed by the lap (52) of the movable scroll (5) coming in contact with the outer peripheral wall (43) of the fixed scroll (4). The other end of the primary path (81) is positioned at a location of the bottom surface of the outer peripheral wall (43), and the end plate (51) of the movable scroll (5) is in contact with the location all the time.

On the other hand, the secondary path (82) is configured to vertically pass through the end plate (51) of the movable scroll (5) from the front surface to the back side. The lower end, i.e., one of the ends of the secondary path (82) communicates with the back pressure space (24) all the time. The upper end, i.e., the other end of the secondary path (82) is open at the front surface of the end plate (51), and is configured to move along the circular locus shown in chain line in FIG. 8, and intermittently communicate with the other end of the primary path (81) as the movable scroll (5) revolves.

Thus, according to the present embodiment, the primary path (81) and the secondary path (82) intermittently communicate with each other as the movable scroll (5) revolves. The back pressure space (24) and the upper space (16) communicate with each other through the space between the housing (3) and the fixed scroll (4). Thus, variations in pressure of the refrigerant gas in the process of being compressed are compensated by the large capacity space including the back pressure space (24) and the upper space (16). As a result, variations in back pressure which is applied to the movable scroll (5) can be reduced, thereby making it possible to stabilize the pushing force given to the movable scroll (5). In this case, too, the upper space (16) serves as an auxiliary space which compensates variations in pressure of the refrigerant gas in the process of being compressed. The other structures and effects are the same as those in the first embodiment.

Fourth Embodiment

Now, the fourth embodiment of the present invention will be described in detail based on the drawings.

Figure 9:
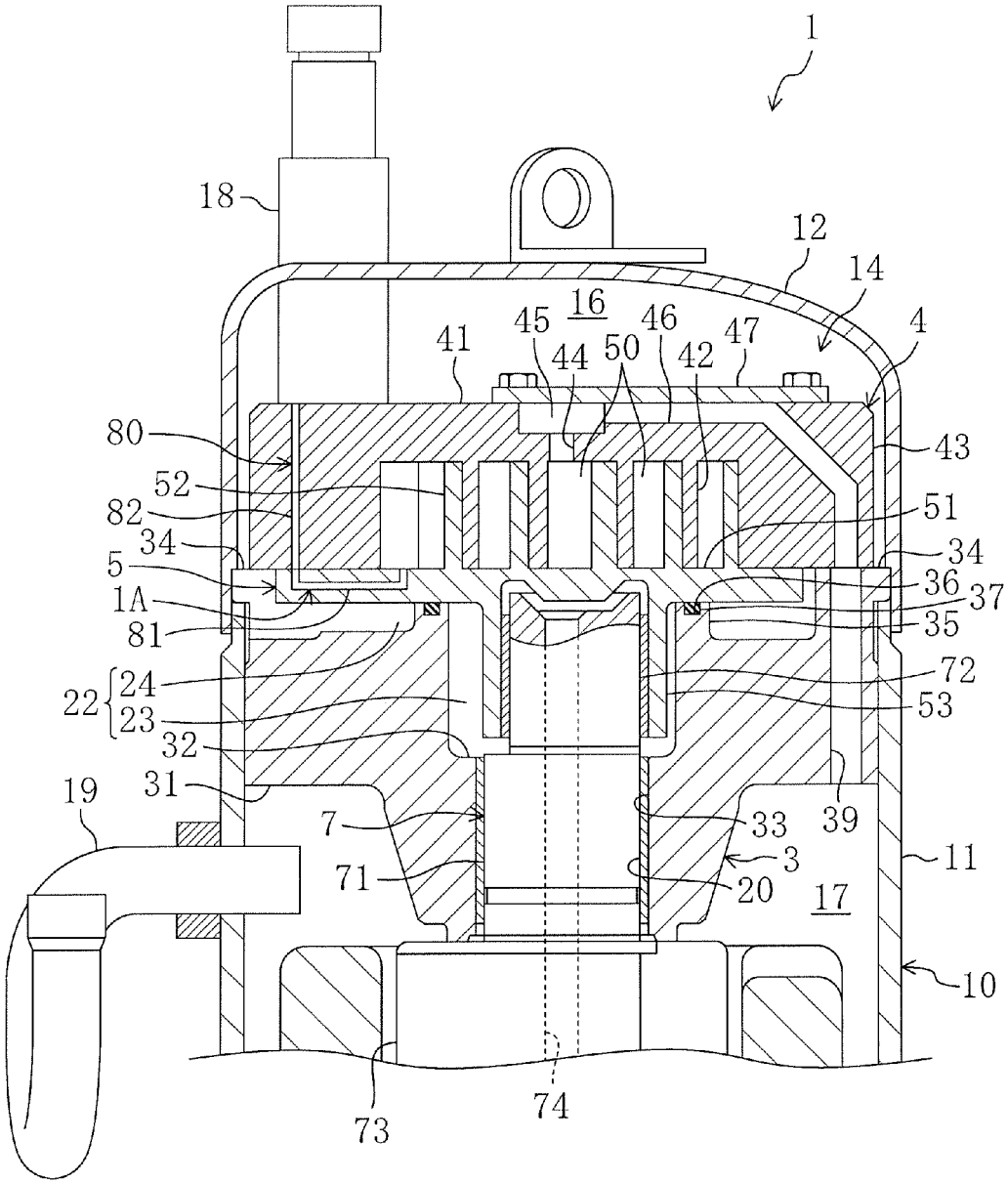
FIG. 9 is a vertical cross section for showing part of a scroll compressor according to the fourth embodiment of the present invention.

As shown in FIG. 9, the structure of the flow mechanism (1A) of the present embodiment is such that a communication path (80) extends from the movable scroll (5) to the fixed scroll (4), different from the structure in the third embodiment in which the communication path (80) extends from the fixed scroll (4) to the movable scroll (5).

Specifically, the communication path (80) includes a primary path (81) formed in the movable scroll (5) and a secondary path (82) formed in the fixed scroll (4). The primary path (81) is a U-shaped path formed in the end plate (51) of the movable scroll (5), and the both ends of the primary path (81) are open at the front surface of the end plate (51) of the movable scroll (5). The primary path (81) extends from a central portion of the end plate (51) to the outer peripheral edge of the end plate (51). One end of the primary path (81) communicate with the compression chamber (50) in a state of intermediate pressure that is formed by the lap (52) of the movable scroll (5) coming in contact with the outer peripheral wall (43) of the fixed scroll (4). The other end of the primary path (81) faces toward the bottom surface of the outer peripheral wall (43) of the fixed scroll (4), the bottom surface being in contact with the end plate (51) of the movable scroll (5) all the time.

On the other hand, the secondary path (82) is configured to vertically pass through the outer peripheral wall (43) of the fixed scroll (4) from the front surface to the back side. The upper end, i.e., one of the ends of the secondary path (82) communicates with the upper space (16) all the time. The lower end, i.e., the other end of the secondary path (82) is open at the bottom surface, i.e., the front surface of the outer peripheral wall (43). The other end of the primary path (81) intermittently communicates with the lower end of the secondary path (82) as the movable scroll (5) revolves.

Thus, according to the present embodiment, the primary path (81) and the secondary path (82) intermittently communicate with each other as the movable scroll (5) revolves. The back pressure space (24) and the upper space (16) communicate with each other through the space between the housing (3) and the fixed scroll (4). Thus, variations in pressure of the refrigerant gas in the process of being compressed are compensated by the large capacity space including the back pressure space (24) and the upper space (16). As a result, variations in back pressure which is applied to the movable scroll (5) can be reduced, thereby making it possible to stabilize the pushing force given to the movable scroll (5). In this case, too, the upper space (16) serves as an auxiliary space which compensates variations in pressure of the refrigerant gas in the process of being compressed. The other structures and effects are the same as those in the third embodiment.

Fifth Embodiment

Now, the fifth embodiment of the present invention will be described in detail based on the drawings.

Figure 10:
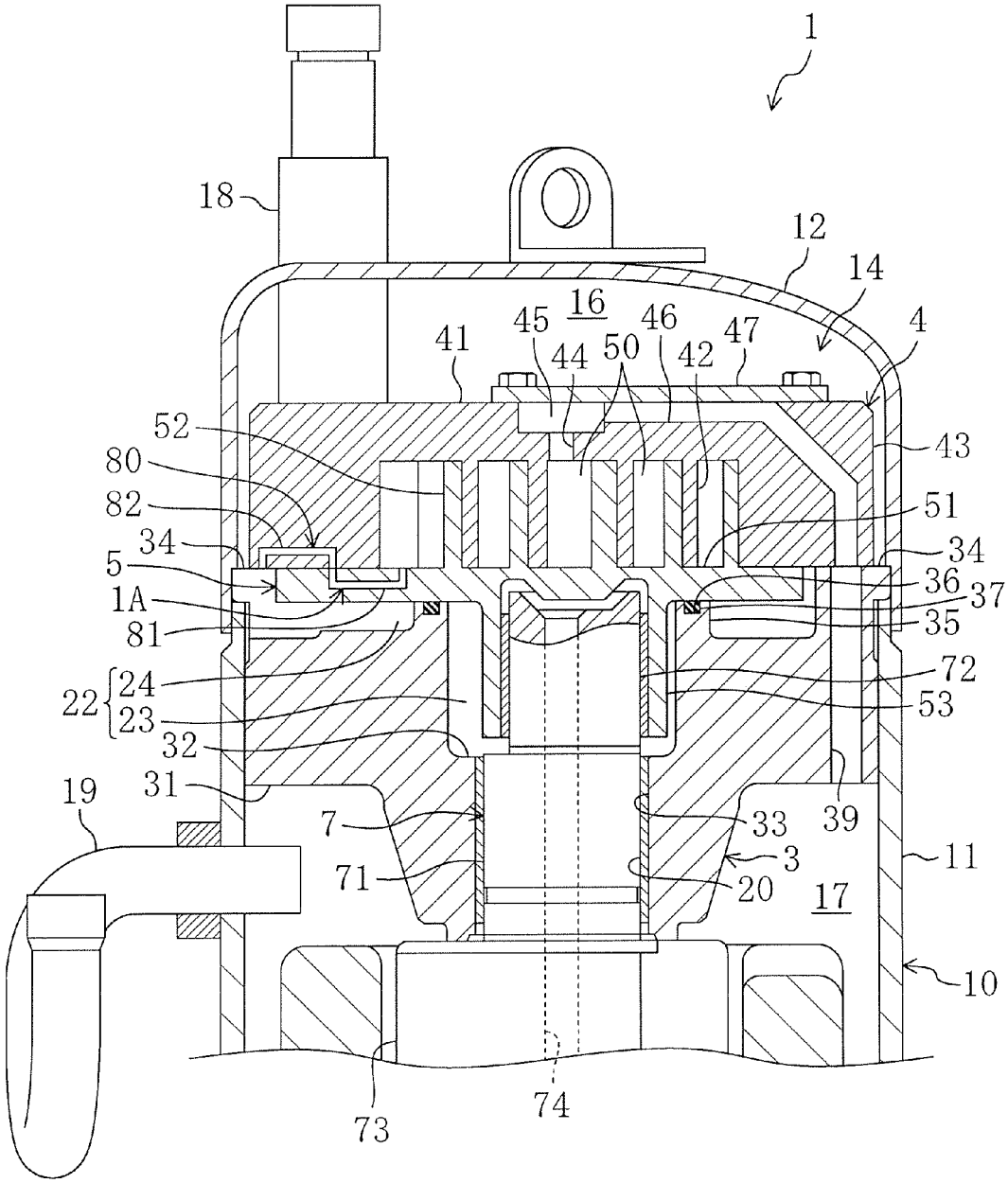
FIG. 10 is a vertical cross section for showing part of a scroll compressor according to the fifth embodiment of the present invention.

As shown in FIG. 10, the structure of the flow mechanism (1A) of the present embodiment is such that a communication path (80) extends from the movable scroll (5) to the fixed scroll (4), different from the structure in the third embodiment in which the communication path (80) extends from the fixed scroll (4) to the movable scroll (5).

Specifically, the communication path (80) includes a primary path (81) formed in the movable scroll (5), and a secondary path (82) formed in the fixed scroll (4). The primary path (81) is a U-shaped path formed in the end plate (51) of the movable scroll (5), and the both ends of the primary path (81) are open at the front surface of the end plate (51) of the movable scroll (5). The primary path (81) extends from a central portion of the end plate (51) to the outer peripheral edge of the end plate (51). One end of the primary path (81) communicates with the compression chamber (50) in a state of intermediate pressure that is formed by the lap (52) of the movable scroll (5) coming in contact with the outer peripheral wall (43) of the fixed scroll (4). The other end of the primary path (81) faces toward the bottom surface of the outer peripheral wall (43) of the fixed scroll (4), the bottom surface being in contact with the end plate (51) of the movable scroll (5) all the time.

On the other hand, the secondary path (82) is an inverted U-shaped path formed in the outer peripheral wall (43) of the fixed scroll (4), and the both ends of the secondary path (82) are open to the front surface (bottom surface) of the outer peripheral wall (43) of the fixed scroll (4). The secondary path (82) extends in a radial direction at an outer peripheral portion of the outer peripheral wall (43). One end of the secondary path (82) faces toward a location of the bottom surface of the outer peripheral wall (43) of the fixed scroll (4), the location of the bottom surface being in contact with the end plate (51) of the movable scroll (5) all the time. The other end of the secondary path (82) faces toward, and is always open at a location of the bottom surface of an outer peripheral portion of the fixed scroll (4), the location of the bottom surface never coming in contact with the end plate (51) of the movable scroll (5).

Thus, according to the present embodiment, the outer peripheral end of the primary path (81) and the inner peripheral end of the secondary path (82) intermittently communicate with each other as the movable scroll (5) revolves. The back pressure space (24) and the upper space (16) communicate with each other through the space between the housing (3) and the fixed scroll (4). Thus, variations in pressure of the refrigerant gas in the process of being compressed are compensated by the large capacity space including the back pressure space (24) and the upper space (16). As a result, variations in back pressure which is applied to the movable scroll (5) can be reduced, thereby making it possible to stabilize the pushing force given to the movable scroll (5). In this case, too, the upper space (16) serves as an auxiliary space which compensates variations in pressure of the refrigerant gas in the process of being compressed. The other structures and effects are the same as those in the third embodiment.

Other Embodiments

The structures described in the above embodiments of the present invention may have the following structures, as well.

In the embodiments, the inside of the casing (10) is partitioned into the upper space (16) and the lower space (17) by the housing (3). However, the structure is not limited to this structure. For example, a partition member for partitioning the inside of the casing (10) may be provided to form an auxiliary space.

Further, in the embodiments, the upper space (16) serves as an auxiliary space, and the lower space (17) serves as a high pressure space. However, the lower space (17) may serves as a low pressure space in which the pressure is a suction pressure.

Further, the lower space (17) may serve as an auxiliary space, and the upper space (16) may serve as a high pressure space or a low pressure space. In that case, the lower space (17) and the back pressure space (24) are connected to each other to make the back pressure space (24) has an intermediate pressure.

Further, in the first embodiment, the reed valve (49) is provided to the communication path (48) as a check valve. However, a check valve of a different type may be provided, or a check valve may not be provided. In that case, it is preferable that the communication path (48) is throttled to a degree in order that the refrigerant gas does not easily flow between the compression chamber (50) and the upper space (16).

Further, a scroll compressor (1) provided in a refrigerant circuit was described in the embodiments. However, a device for compressing various kinds of fluid may be applied as the scroll compressor (1) of the present invention.

The foregoing embodiments are merely preferred examples in nature, and are not intended to limit the scope, applications, and use of the invention.

INDUSTRIAL APPLICABILITY

As described above, the present invention is useful as a scroll compressor in which an intermediate pressure is applied to a back side of a movable scroll to push the movable scroll toward a fixed scroll.

What is claimed is:

1. A scroll compressor comprising:

a casing;

a compressor mechanism accommodated in the casing, the compressor mechanism including a fixed scroll and a movable scroll arranged to form a compression chamber therebetween;

a motor accommodated in the casing and connected to the compressor mechanism via a drive shaft;

a housing disposed on a back side of the movable scroll to form a back pressure space between the housing and the movable scroll, the housing partitioning the casing into an accommodating space for the compressor mechanism and an accommodating space for the motor;

the accommodating space for the compressor mechanism always communicating with the back pressure space and forming an auxiliary space;

a flow mechanism arranged to enable a fluid to flow between the back pressure space and the auxiliary space, and the compression chamber in a process of compression;

the back pressure space and the auxiliary space are in an intermediate pressure state between a pressure of the fluid sucked in the compression chamber and a pressure of the fluid discharged from the compression chamber;

a space between the movable scroll and the housing being partitioned into a central space through which the drive shaft passes, and the back pressure space, which is formed on an outer side of the central space, and the central space being in an atmosphere of a discharge pressure of the fluid.

2. The scroll compressor of claim 1, wherein the flow mechanism includes a communication path extending from the fixed scroll to the movable scroll, and connecting the compression chamber and the back pressure space to each other.

3. The scroll compressor of claim 2, wherein the communication path communicates the compression chamber and the back pressure space intermittently as the movable scroll revolves.

4. The scroll compressor of claim 1, wherein the flow mechanism includes a communication path extending from the movable scroll to the fixed scroll, and connecting the compression chamber and the auxiliary space to each other.

5. The scroll compressor of claim 4, wherein the communication path communicates the compression chamber and the auxiliary space intermittently as the movable scroll revolves.

6. The scroll compressor of claim 1, wherein the flow mechanism includes a communication path extending from the movable scroll to the fixed scroll, and connecting the compression chamber and the back pressure space to each other.

7. The scroll compressor of claim 6, wherein the communication path communicates the compression chamber and the back pressure space intermittently as the movable scroll revolves.

8. The scroll compressor of claim 1, wherein the flow mechanism includes a communication path formed in the fixed scroll and connecting the compression chamber and the auxiliary space to each other.

9. The scroll compressor of claim 8, wherein the communication path is provided with a check valve arranged to prevent a fluid from flowing back to the compression chamber.

10. The scroll compressor of claim 1, wherein the flow mechanism includes a communication path formed in the movable scroll and connecting the compression chamber and the back pressure space to each other.

11. The scroll compressor of claim 10, wherein the communication path is provided with a check valve arranged to prevent a fluid from flowing back to the compression chamber.

12. The scroll compressor of claim 1, wherein a high pressure chamber is disposed on the back side of the fixed scroll, the high pressure chamber is separated from the auxiliary space, and a fluid compressed in the compression chamber is discharged into the high pressure chamber, flow paths are arranged to connect the high pressure chamber and the motor accommodating space, and the flow paths are formed so as to extend from the fixed scroll to the housing, and a discharge pipe communicating with the motor accommodating space is connected to the casing.

13. The scroll compressor of claim 12, wherein a suction pipe passes through the casing and the auxiliary space to communicate with the compression chamber.

14. The scroll compressor of claim 1, wherein a suction pipe passes through the casing and the auxiliary space to communicate with the compression chamber.

15. A scroll compressor comprising:

a casing;

a compressor mechanism which is accommodated in the casing, the compressor mechanism including a fixed scroll and a movable scroll arranged to form a compression chamber therebetween;

a motor accommodated in the casing and connected to the compressor mechanism via a drive shaft;

a housing disposed on a back side of the movable scroll to form a back pressure space between the housing and the movable scroll, the housing partitioning the casing into an accommodating space for the compressor mechanism and an accommodating space for the motor;

the accommodating space for the compressor mechanism always communicating with the back pressure space and forming an auxiliary space;

a flow mechanism arranged to enable a fluid to flow between the back pressure space and the auxiliary space, and the compression chamber in a process of compression;

the back pressure space and the auxiliary space are in an intermediate pressure state between a pressure of the fluid sucked in the compression chamber and a pressure of the fluid discharged from the compression chamber;

a high pressure chamber being disposed on the back side of the fixed scroll, the high pressure chamber being separated from the auxiliary space, and a fluid compressed in the compression chamber being discharged into the high pressure chamber;

flow paths being arranged to connect the high pressure chamber and the motor accommodating space, and the flow paths being formed so as to extend from the fixed scroll to the housing, and a discharge pipe communicating with the motor accommodating space being connected to the casing.

* * * * *